US010070664B2

(12) United States Patent
Branton et al.

(10) Patent No.: US 10,070,664 B2
(45) Date of Patent: Sep. 11, 2018

(54) ELECTRONIC VAPOR PROVISION SYSTEM

(71) Applicant: Nicoventures Holdings Limited, London (GB)

(72) Inventors: Peter James Branton, London (GB); Anna Azzopardi, London (GB)

(73) Assignee: NICOVENTURES HOLDINGS LIMITED, London (GB)

( * ) Notice: Subject to any disclaimer, the term of this patent is extended or adjusted under 35 U.S.C. 154(b) by 0 days.

(21) Appl. No.: 15/321,646

(22) PCT Filed: Jul. 9, 2015

(86) PCT No.: PCT/GB2015/051995

§ 371 (c)(1),
(2) Date: Dec. 22, 2016

(87) PCT Pub. No.: WO2016/009179

PCT Pub. Date: Jan. 21, 2016

(65) Prior Publication Data

US 2017/0208857 A1 Jul. 27, 2017

(30) Foreign Application Priority Data

Jul. 17, 2014 (GB) ..... 1412752.6

(51) Int. Cl.
*A24F 47/00* (2006.01)
*A24D 3/06* (2006.01)
(Continued)

(52) U.S. Cl.
CPC ..... *A24D 3/067* (2013.01); *A24D 3/08* (2013.01); *A24D 3/12* (2013.01); *A24F 47/008* (2013.01)

(58) Field of Classification Search
None
See application file for complete search history.

(56) References Cited

U.S. PATENT DOCUMENTS 2,968,306 A 1/1961 Touey et al.
3,473,535 A 10/1969 Stahly
(Continued)

FOREIGN PATENT DOCUMENTS

CA 2 813 575 A1 10/2010
CN 202 233 005 U 5/2012
(Continued)

OTHER PUBLICATIONS

International Search Report for corresponding International Application No. PCT/GB2015/051995 dated Oct. 6, 2015; 4 pages.
(Continued)

*Primary Examiner* — Tho D Ta
(74) *Attorney, Agent, or Firm* — Patterson Thuente Pedersen, P.A.

(57) ABSTRACT

There is provided an electronic vapor provision system comprising: a vaporizer for vaporizing liquid for inhalation by a user of the electronic vapor provision system; a power supply comprising a cell or battery for supplying power to the vaporizer; and a filter for filtering vaporized liquid prior to inhalation by the user of the electronic vapor provision system, wherein the filter can partially or completely remove from the vapor one or more aldehydes present in the vapor.

14 Claims, 4 Drawing Sheets

(i) - 60mg AC (HPLC), (ii) - 60mg AC (TOF-MS),

(51) Int. Cl.
*A24D 3/12* (2006.01)
*A24D 3/08* (2006.01)

(56) References Cited

U.S. PATENT DOCUMENTS

| | | | | |
|---|---|---|---|---|
| 3,656,489 | A | 4/1972 | Stahly | |
| 3,894,545 | A | 7/1975 | Crellin et al. | |
| 4,033,361 | A | 7/1977 | Horsewell et al. | |
| 5,060,672 | A | 10/1991 | Irmi et al. | |
| 5,551,450 | A | 9/1996 | Hemsley | |
| 5,909,736 | A | 7/1999 | Stavridis et al. | |
| 6,615,840 | B1 | 9/2003 | Fournier et al. | |
| 6,789,548 | B2 | 9/2004 | Bereman | |
| 6,863,074 | B2 | 3/2005 | Xue et al. | |
| 7,017,585 | B2 | 3/2006 | Li et al. | |
| 7,216,652 | B1 | 5/2007 | Fournier et al. | |
| 8,012,399 | B2 | 9/2011 | Gee et al. | |
| 2002/0179103 | A1 | 12/2002 | Hersh et al. | |
| 2003/0066539 | A1 | 4/2003 | Figlar | |
| 2004/0025895 | A1 | 2/2004 | Li et al. | |
| 2005/0066980 | A1 | 3/2005 | Crooks et al. | |
| 2005/0066981 | A1 | 3/2005 | Crooks et al. | |
| 2005/0066983 | A1 | 3/2005 | Clark et al. | |
| 2005/0066984 | A1 | 3/2005 | Crooks et al. | |
| 2005/0205102 | A1 | 9/2005 | Yang et al. | |
| 2005/0247323 | A1 | 11/2005 | Caraway, Jr. | |
| 2006/0130862 | A1 | 6/2006 | Dittrich et al. | |
| 2006/0185687 | A1 | 8/2006 | Hearn et al. | |
| 2008/0236602 | A1 | 10/2008 | Bereman | |
| 2010/0179133 | A1 | 7/2010 | Gavish et al. | |
| 2010/0206318 | A1 | 8/2010 | Salaspuro et al. | |
| 2011/0155154 | A1 | 7/2011 | Zhuang et al. | |
| 2011/0253155 | A1 | 10/2011 | Taniguchi | |
| 2012/0024304 | A1 | 2/2012 | Sebastian | |
| 2013/0192620 | A1* | 8/2013 | Tucker ..... | H01C 17/00 131/329 |

FOREIGN PATENT DOCUMENTS

| | | | |
|---|---|---|---|
| EP | 1 234 512 | A2 | 8/2002 |
| EP | 1 470 760 | A1 | 10/2004 |
| EP | 1 541 043 | A1 | 6/2005 |
| EP | 1 541 044 | A1 | 6/2005 |
| EP | 1 611 804 | A1 | 1/2006 |
| EP | 1 839 507 | A1 | 10/2007 |
| EP | 1 856 991 | A1 | 11/2007 |
| EP | 1 908 362 | A1 | 4/2008 |
| EP | 2 092 838 | A1 | 8/2009 |
| EP | 2 382 879 | A1 | 11/2011 |
| EP | 2 412 423 | A1 | 2/2012 |
| EP | 2 454 955 | A2 | 5/2012 |
| GB | 1 164 425 | | 9/1969 |
| GB | 1 509 197 | | 5/1978 |
| WO | WO 99/38396 | | 8/1999 |
| WO | WO 00/22946 | | 4/2000 |
| WO | WO 01/80973 | A1 | 11/2001 |
| WO | WO 01/84969 | A1 | 11/2001 |
| WO | WO 2004/041008 | A1 | 5/2004 |
| WO | WO 2004/103099 | A2 | 12/2004 |
| WO | WO 2005/032287 | A2 | 4/2005 |
| WO | WO 2005/094619 | A1 | 10/2005 |
| WO | WO 2008/07315 | A2 | 6/2008 |
| WO | WO 2008/073211 | A2 | 6/2008 |
| WO | WO 2008/073215 | A2 | 6/2008 |
| WO | WO 2008/073216 | A2 | 6/2008 |
| WO | WO 2008/117886 | A1 | 10/2008 |
| WO | WO 2008/136000 | A2 | 11/2008 |
| WO | WO 2009/024868 | A2 | 2/2009 |
| WO | WO 2009/031246 | A1 | 3/2009 |
| WO | WO 2009/034232 | A1 | 3/2009 |
| WO | WO 2009/081214 | A1 | 7/2009 |
| WO | WO 2011/084907 | A1 | 7/2011 |
| WO | WO 2011/121358 | A1 | 10/2011 |
| WO | WO 2013/067511 | A2 | 5/2013 |

OTHER PUBLICATIONS

Written Opinion of the International Searching Authority for corresponding International Application No. PCT/GB2015/051995 dated Oct. 6, 2015; 6 pages.

Written Opinion of the International Preliminary Examining Authority for corresponding International Application No. PCT/GB2015/051995 dated Jun. 2, 2016; 7 pages.

International Preliminary Report on Patentability for corresponding International Application No. PCT/GB2015/051995 dated Nov. 3, 2016; 16 pages.

Search Report for corresponding GB Application No. 1412752.6 dated Jan. 13, 2015; 4 pages.

Pre-Exam Communication for corresponding GB Application No. 1412752.6 dated Jan. 13, 2015; 2 pages.

Branton et al, "Reduction of aldehydes and hydrogen cyanide yields in mainstream cigarette smoke using an amine functionalised ion exchange resin," Chemistry Central Journal (2011) 5 (15); 14 pages.

Branton et al., "Use of classical adsorption theory to understand the dynamic filtration of volatile toxicants in cigarette smoke by active carbons," Adsorption Science & Technology (2011) vol. 29, No. 2; p. 117-138.

Kosmider et al., "Carbonyl compounds in electronic cigarette vapors—effects of nicotine solvent and battery output voltage," Nicotine & Tobacco Research Advance Access (May 15, 2014); 8 pages.

Ohta et al., "Determination of carbonyl compounds generated from the electronic cigarette using coupled silica cartridges impregnated with hydroquinone and 2,4-dinitrophenylhydrazine," The Japan Society for Analytical Chemistry (2011) vol. 60, No. 10; p. 791-797.

Rohm and Haas, "Amberlite™ IRA96SB Industrial Grade Weak Base Anion Exchanger Product Data Sheet," (Jan. 1, 2008) XP055196812; 3 pages. Retrieved online on Jun. 18, 2015 <http://www.dow.com/assets/attachments/business/ier_for_indutrial_water_treatment/amberlite_ira96sb/tds/amberlite_ira96sb.pdf [retrieved Jun. 19, 2015]>.

Uchiyama et al, "Determination of carbonyl compounds generated from the e-cigarette using coupled silica cartridges impregnated with hydroquinone and 2,4-dinitrophenylhydrazine, followed by high-performance liquid chromatography," Analytical Sciences (Dec. 2013) vol. 29; p. 1219-1222.

Branton et al., "Reduction of Aldehydes and Hydrogen Cyanide Yields in Mainstream Cigarette Smoke Using an Amine Functionalised Ion Exchange Resin", *Chemistry Central Journal*, 2011, 14 pages.

Russian Office Action, Application No. 2017101165, dated Nov. 21, 2017, 4 pages.

Russian Search Report, Application No. 2017101165, dated Nov. 21, 2017, 2 pages.

* cited by examiner

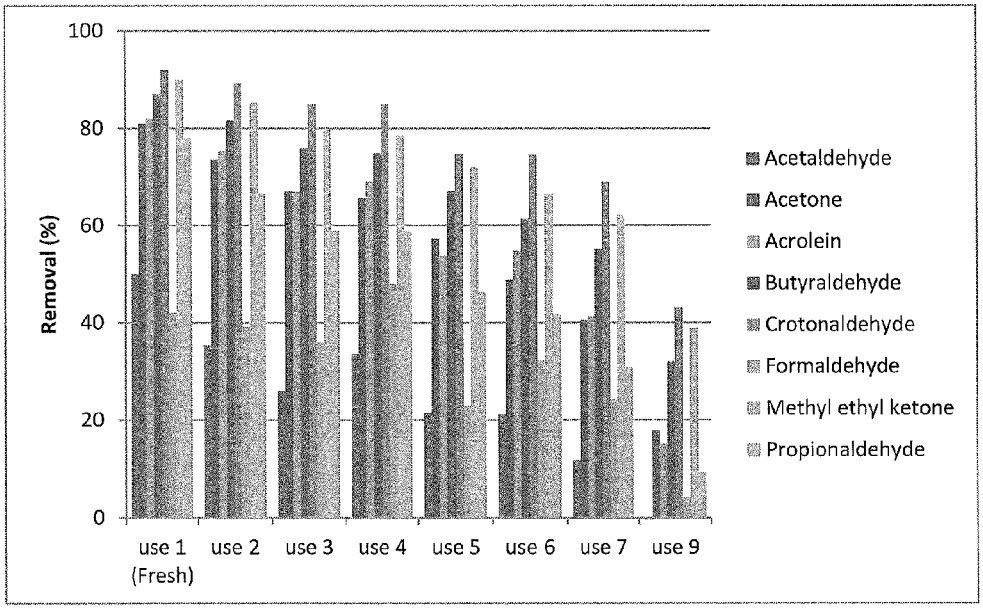
Figure 1(i) - 60mg AC (HPLC),
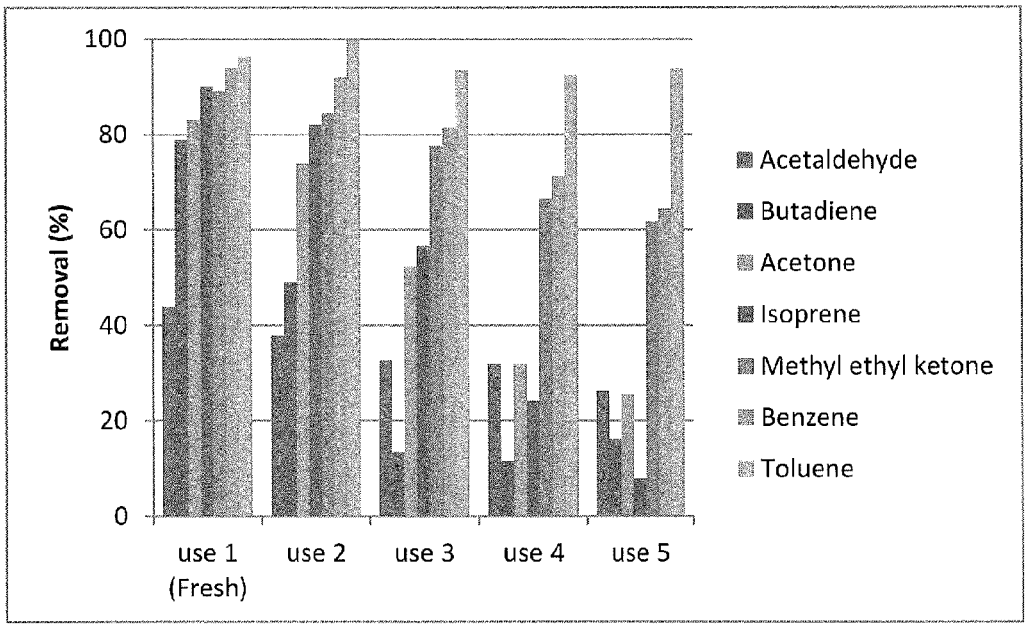
Figure 1(ii) - 60mg AC (TOF-MS),

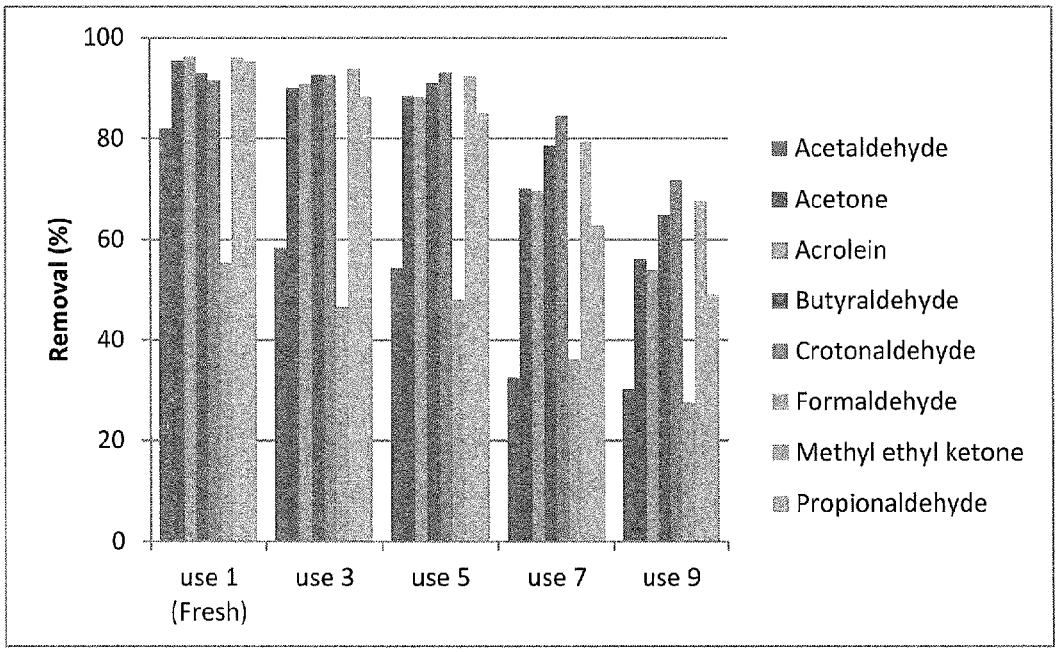
Figure 1(iii) - 150mg AC (HPLC)
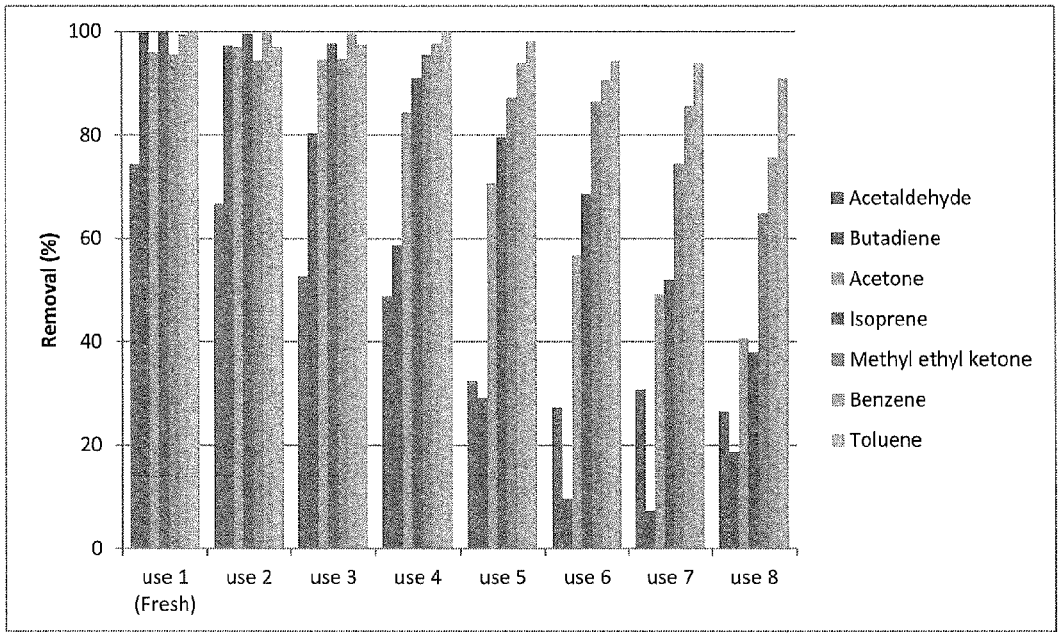
Figure 1(iv) - 150mg AC (TOF-MS),

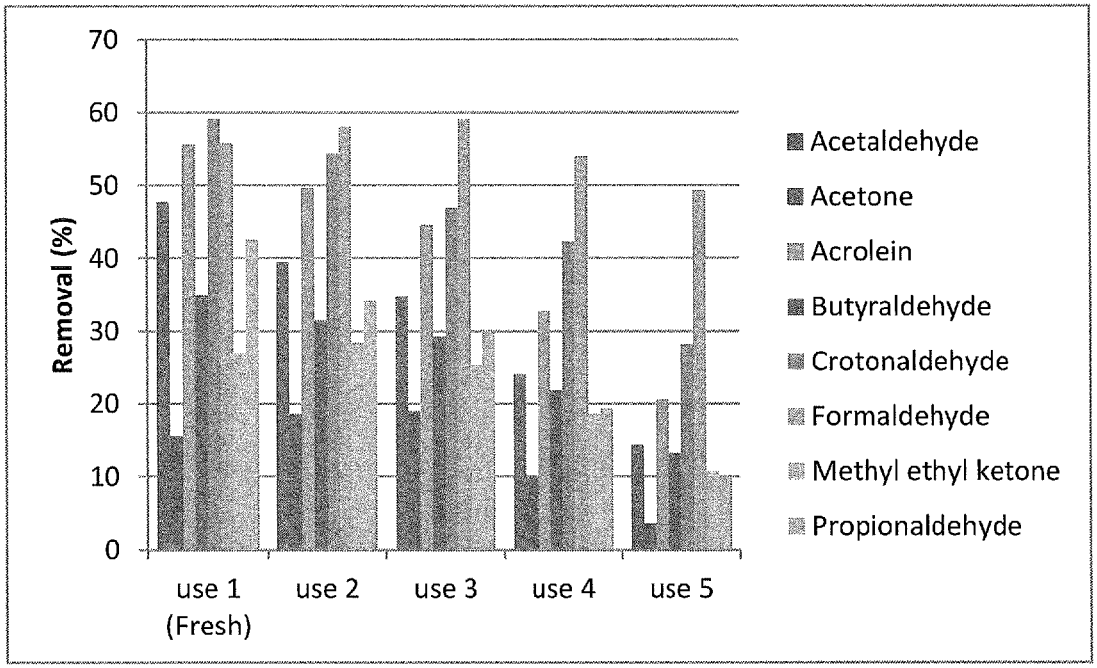
Figure 1(v) - 60mg CR20 (HPLC)

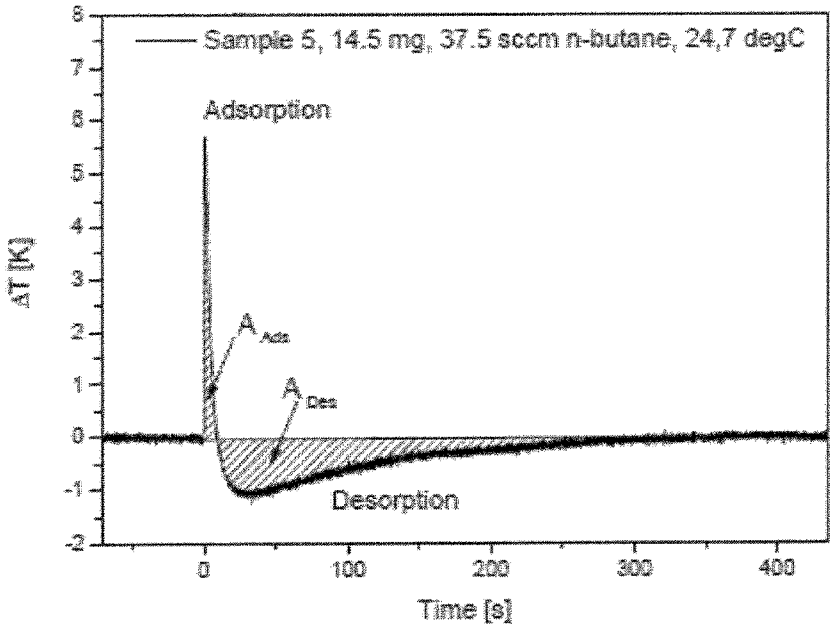
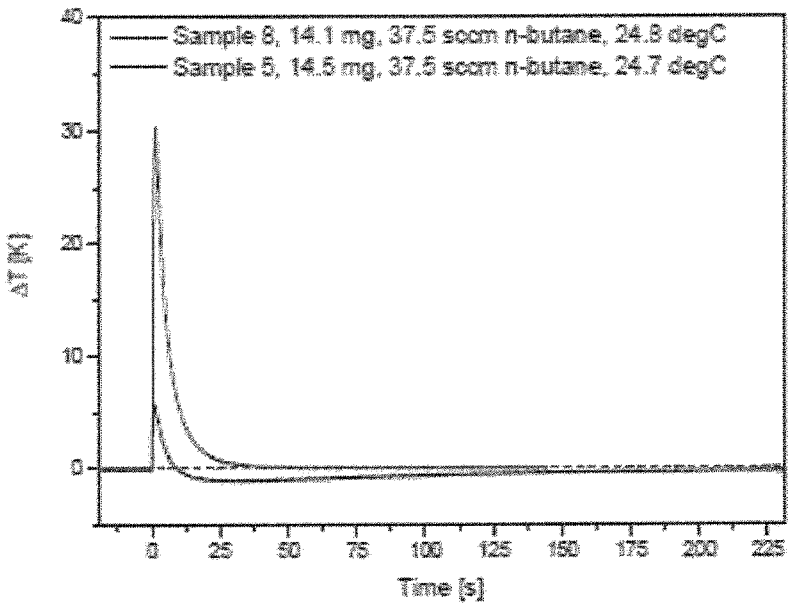
Figure 2 - Sample 8 Fresh AC, sample 5 AC exposed to 5 uses

ELECTRONIC VAPOR PROVISION SYSTEM

CROSS-REFERENCE TO RELATED APPLICATIONS

The present application is a National Phase entry of PCT Application No. PCT/GB2015/051995, filed on 9 Jul. 2015, which claims priority to GB Patent Application No. 1412752.6, filed on 17 Jul. 2014, which are hereby fully incorporated herein by reference.

TECHNICAL FIELD

The present disclosure relates to electronic vapor provision systems such as electronic nicotine delivery systems (e.g. e-cigarettes).

BACKGROUND

Electronic vapor provision systems such as e-cigarettes generally contain a reservoir of liquid which is to be vaporized, typically nicotine. When a user inhales on the device, a heater is activated to vaporize a small amount of liquid, which is therefore inhaled by the user.

The use of e-cigarettes in the UK has grown rapidly, and it has been estimated that there are now over a million people using them in the UK.

During the operation of electronic vapor provision systems, the heater may heat the liquid to be vaporized to an extent that some undesirable impurities are formed by the heating. For example, the liquid may be heated to the extent that undesirable aldehyde compounds may be formed. Such compounds may impact on the taste of the inhaled vapor.

SUMMARY

In one aspect, there is provided an electronic vapor provision system comprising: a vaporizer for vaporizing liquid for inhalation by a user of the electronic vapor provision system; a power supply comprising a cell or battery for supplying power to the vaporizer; and a filter for filtering vaporized liquid prior to inhalation by the user of the electronic vapor provision system, wherein the filter can partially or completely remove from the vapor one or more aldehydes present in the vapor.

We have found that aldehydes, which are undesirable at least because of the taste which they may impart to the vapor, may be produced by the heating of the liquid to be vaporized. We have found that the aldehydes have a particular tendency to form in vapor provision systems, such as e-cigarettes, and this is especially the case towards the end of the use of the vapor provision system. Towards the end of the use of the system when the amount of liquid present in the device is low, the heater may contact a relatively small amount of liquid and heat the liquid to a temperature which is higher than the typical temperature during the majority of the operation of the device. This is a problem unique to electronic vapor provision systems containing a heating element. The provision of a filter that can partially or completely remove from the vapor one or more aldehydes present in the vapor addresses this problem.

That filters can be provided which remove aldehydes from the vapor of electronic vapor provision systems was surprising at least because the airflow observed in such vapor provision systems is very different to that seen in systems where similar filters have previously been used, such as in combustible tobacco products. Furthermore, the number of puffs taken on a single electronic vapor provision system, such as an e-cigarette, can be as high as 250 or 300. In contrast the number of puffs taken on a single combustible cigarette is typically less than 10.

For ease of reference, these and further aspects of the present disclosure are now discussed under appropriate section headings. However, the teachings under each section are not necessarily limited to each particular section.

BRIEF DESCRIPTION OF THE DRAWINGS

Various embodiments will now be described by way of example with reference to the following drawings:

FIGS. 1(*i*) to (*v*) show the effect on filtration efficiency as a function of usage using 60 mg and 150 mg of Activated Carbon (AC) beads in the filter by TOF-MS and HPLC analytical procedures and 60 mg CR20 by HPLC.

FIG. 2 shows the thermal response of AC that was used 5 times (using 150 mg in the filter) and 'fresh' AC upon exposure to n-butane gas.

DETAILED DESCRIPTION

As described above, the present disclosure relates to an electronic vapor provision system, such as an e-cigarette. Throughout the following description the term "e-cigarette" is used; however, this term may be used interchangeably with electronic vapor provision system.

As discussed herein, the filter used in the present disclosure can partially or completely remove from the vapor one or more aldehydes present in the vapor. In one aspect, the filter partially or completely removes at least one aldehyde present in the vapor. In one aspect, the filter partially or completely removes at least two aldehydes present in the vapor. In one aspect, the filter partially or completely removes at least three aldehydes present in the vapor. In one aspect, the filter partially or completely removes each aldehyde present in the vapor.

As will be understood by one skilled in the art when aldehydes are formed in an electronic vapor provision system, some of the aldehydes are present in the particulate phase and some of the aldehydes are present in the vapor phase. The filter of the present disclosure acts to selectively remove aldehydes from the vapor phase and the purpose of the filter is not to remove aldehydes from the particulate phase. In the present specification (unless otherwise stated) all references to removal of aldehydes from the vapor phase refer only to the removal of aldehydes within that vapor phase and not the removal of any aldehydes within the particulate phase. It will be understood by one skilled in the art that the particulate phase may be carried by the vapor phase. References in the present specification to the removal of particular amounts of aldehyde from the vapor phase are based (unless otherwise stated) on the amount of aldehyde in the vapor phase and do not refer to or include the amount of aldehyde present in the particulate phase, irrespective of whether that particulate phase is carried by the vapor phase.

By the term "partially removes" it is meant that during an inhalation of vapor through the filter at least a portion of aldehyde is removed. In one aspect the term "partially removes" means at least 10 wt. % of aldehyde present in the vapor is removed from the vapor by the filter. In one aspect the term "partially removes" means at least 20 wt. % of aldehyde present in the vapor is removed from the vapor by the filter. In one aspect the term "partially removes" means at least 30 wt. % of aldehyde present in the vapor is removed from the vapor by the filter. In one aspect the term "partially removes" means at least 40 wt. % of aldehyde present in the vapor is removed from the vapor by the filter. In one aspect the term "partially removes" means at least 50 wt. % of aldehyde present in the vapor is removed from the vapor by the filter. In one aspect the term "partially removes" means at least 60 wt. % of aldehyde present in the vapor is removed from the vapor by the filter. In one aspect the term "partially removes" means at least 70 wt. % of aldehyde present in the vapor is removed from the vapor by the filter. In one aspect the term "partially removes" means at least 80 wt. % of aldehyde present in the vapor is removed from the vapor by the filter. In one aspect the term "partially removes" means at least 90 wt. % of aldehyde present in the vapor is removed from the vapor by the filter.

It is desirable that the filter of the present disclosure remains active over a significant number of uses. In particular it is desirable that the filter of the present disclosure remains active over the large number of inhalations which an e-cigarette is designed to provide. In one aspect after 30 inhalations of vapor have passed through the filter at least 30 wt. % of the one or more aldehydes present in the vapor are removed from the vapor by the filter. In one aspect after 30 inhalations of vapor have passed through the filter at least 40 wt. % of the one or more aldehydes present in the vapor are removed from the vapor by the filter. In one aspect after 30 inhalations of vapor have passed through the filter at least 50 wt. % of the one or more aldehydes present in the vapor are removed from the vapor by the filter. In one aspect after 30 inhalations of vapor have passed through the filter at least 60 wt. % of the one or more aldehydes present in the vapor are removed from the vapor by the filter.

In one aspect after 30 inhalations of vapor have passed through the filter at least 30 wt. % of formaldehyde present in the vapor is removed from the vapor by the filter. In one aspect after 30 inhalations of vapor have passed through the filter at least 40 wt. % of formaldehyde present in the vapor is removed from the vapor by the filter. In one aspect after 30 inhalations of vapor have passed through the filter at least 50 wt. % of formaldehyde present in the vapor is removed from the vapor by the filter. In one aspect after 30 inhalations of vapor have passed through the filter at least 60 wt. % of formaldehyde present in the vapor is removed from the vapor by the filter.

In one aspect after 100 inhalations of vapor have passed through the filter at least 20 wt. % of formaldehyde present in the vapor is removed from the vapor by the filter. In one aspect after 100 inhalations of vapor have passed through the filter at least 30 wt. % of formaldehyde present in the vapor is removed from the vapor by the filter. In one aspect after 100 inhalations of vapor have passed through the filter at least 40 wt. % of formaldehyde present in the vapor is removed from the vapor by the filter. In one aspect after 100 inhalations of vapor have passed through the filter at least 50 wt. % of formaldehyde present in the vapor is removed from the vapor by the filter. In one aspect after 100 inhalations of vapor have passed through the filter at least 60 wt. % of formaldehyde present in the vapor is removed from the vapor by the filter.

In one aspect after 250 inhalations of vapor have passed through the filter at least 20 wt. % of formaldehyde present in the vapor is removed from the vapor by the filter. In one aspect after 250 inhalations of vapor have passed through the filter at least 30 wt. % of formaldehyde present in the vapor is removed from the vapor by the filter. In one aspect after 250 inhalations of vapor have passed through the filter at least 40 wt. % of formaldehyde present in the vapor is removed from the vapor by the filter. In one aspect after 250 inhalations of vapor have passed through the filter at least 50 wt. % of formaldehyde present in the vapor is removed from the vapor by the filter. In one aspect after 250 inhalations of vapor have passed through the filter at least 60 wt. % of formaldehyde present in the vapor is removed from the vapor by the filter.

In one aspect after 300 inhalations of vapor have passed through the filter at least 20 wt. % of formaldehyde present in the vapor is removed from the vapor by the filter. In one aspect after 300 inhalations of vapor have passed through the filter at least 30 wt. % of formaldehyde present in the vapor is removed from the vapor by the filter. In one aspect after 300 inhalations of vapor have passed through the filter at least 40 wt. % of formaldehyde present in the vapor is removed from the vapor by the filter. In one aspect after 300 inhalations of vapor have passed through the filter at least 50 wt. % of formaldehyde present in the vapor is removed from the vapor by the filter. In one aspect after 300 inhalations of vapor have passed through the filter at least 60 wt. % of formaldehyde present in the vapor is removed from the vapor by the filter.

The nature of the aldehydes to be removed from the vapor may depend on the liquid being vaporized. In one aspect the vapor contains and the filter can partially or completely remove from the vapor one or more aldehydes selected from acetaldehyde, acrolein, butyraldehyde, crotonaldehyde, formaldehyde and propionaldehyde. In one aspect the vapor contains and the filter can partially or completely remove from the vapor two or more aldehydes selected from acetaldehyde, acrolein, butyraldehyde, crotonaldehyde, formaldehyde and propionaldehyde. In one aspect the vapor contains and the filter can partially or completely remove from the vapor three or more aldehydes selected from acetaldehyde, acrolein, butyraldehyde, crotonaldehyde, formaldehyde and propionaldehyde. In one aspect the vapor contains and the filter can partially or completely remove from the vapor four or more aldehydes selected from acetaldehyde, acrolein, butyraldehyde, crotonaldehyde, formaldehyde and propionaldehyde. In one aspect the vapor contains and the filter can partially or completely remove from the vapor five or more aldehydes selected from acetaldehyde, acrolein, butyraldehyde, crotonaldehyde, formaldehyde and propionaldehyde. In one aspect the vapor contains and the filter can partially or completely remove from the vapor each of acetaldehyde, acrolein, butyraldehyde, crotonaldehyde, formaldehyde and propionaldehyde.

In one aspect the vapor contains and the filter can partially or completely remove from the vapor at least one or more aldehydes selected from acetaldehyde, acrolein and formaldehyde. In one aspect the vapor contains and the filter can partially or completely remove from the vapor two or more aldehydes selected from acetaldehyde, acrolein and formaldehyde. In one aspect the vapor contains and the filter can partially or completely remove from the vapor each of acetaldehyde, acrolein and formaldehyde.

In one aspect the vapor contains and the filter can partially or completely remove from the vapor at least formaldehyde. In one aspect the vapor contains and the filter can partially or completely remove from the vapor at least acetaldehyde. In one aspect the vapor contains and the filter can partially or completely remove from the vapor at least acrolein. In one aspect the vapor contains and the filter can partially or completely remove from the vapor at least acetaldehyde and formaldehyde. In one aspect the vapor contains and the filter can partially or completely remove from the vapor at least acrolein and formaldehyde.

A "key" aldehyde to be removed from vapor is formaldehyde. In one aspect the vapor contains and the filter can partially or completely remove from the vapor at least formaldehyde. In one aspect the vapor contains formaldehyde and the filter can remove from the vapor at least 10 wt. % of the formaldehyde present in the vapor. In one aspect the vapor contains formaldehyde and the filter can remove from the vapor at least at least 20 wt. % of the formaldehyde present in the vapor. In one aspect the vapor contains formaldehyde and the filter can remove from the vapor at least at least 30 wt. % of the formaldehyde present in the vapor. In one aspect the vapor contains formaldehyde and the filter can remove from the vapor at least at least 40 wt. % of the formaldehyde present in the vapor. In one aspect the vapor contains formaldehyde and the filter can remove from the vapor at least at least 50 wt. % of the formaldehyde present in the vapor. In one aspect the vapor contains formaldehyde and the filter can remove from the vapor at least at least 60 wt. % of the formaldehyde present in the vapor. In one aspect the vapor contains formaldehyde and the filter can remove from the vapor at least at least 70 wt. % of the formaldehyde present in the vapor. In one aspect the vapor contains formaldehyde and the filter can remove from the vapor at least at least 80 wt. % of the formaldehyde present in the vapor. In one aspect the vapor contains formaldehyde and the filter can remove from the vapor at least at least 90 wt. % of the formaldehyde present in the vapor.

The filter can partially or completely remove from the vapor one or more aldehydes present in the vapor. As will be understood by one skilled in the art the effectiveness of the filter will depend on the extent to which it has already filtered aldehyde from the vapor. The removal may be achieved by any known mechanism by which a filter material may remove a constituent from a vapor. Typically the filter adsorbs the one or more aldehydes or the filter reacts with one or more aldehydes. In one aspect, the filter adsorbs the one or more aldehydes. As will be understood by one skilled in the art, in this context, adsorption is the adhesion to a surface of the filter material aldehyde present in the vapor. In one aspect, the filter reacts with one or more aldehydes. In the process known as chemisorption, a bond will be formed between aldehyde and the material of the filter. In a typical and advantageous aspect, the filter is provided with an amine functional group. When an amine functional group reacts with an aldehyde it forms an imine.

In one aspect, the filter physically adsorbs the one or more aldehydes. In this aspect, the filter may be selected from any suitable adsorbent materials. In this aspect, advantageously the filter comprises or is activated carbon (AC).

In one aspect, the filter reacts with aldehydes. In this aspect, the filter may be selected from any suitable materials which may react with the one or more aldehydes. As discussed above, preferably this is achieved by selection of a filter containing or carrying an amine functional group with reacts with an aldehyde. In one aspect, the filter is a resin having polyamine groups bonded to a cross-linked polystyrene matrix. Advantageously the reactive filter material is an ion exchange resin.

Ion exchange resins are highly ionic, covalently cross-linked, insoluble polyelectrolytes. They are often supplied as porous beads or granules, their high surface area:volume ratio maximizing the rate of ion exchange and the total ion exchange capacity. They can be precisely engineered to have a particular porosity and surface chemistry (i.e. surface functional groups for ion exchange), these features facilitating selective and effective ion exchange. They can be fabricated by cross-linking polymer molecules. In some cases, they can be made by cross-linking polystyrene using the cross-linking agent, divinylbenzene.

The composition of embodiments of the present disclosure may comprise any ion exchange resin as long as it is suitable for incorporating into an e-cigarette. In some embodiments, the ion exchange resin may comprise ion exchange resin beads. In these embodiments, the beads may have any suitable size (i.e. diameter) and any suitable size distribution. In some embodiments, the beads may have a mean diameter of from about 20 to about 1200 μm, from about 100 to about 1100 μm, from about 200 to about 1000 μm, from about 300 to about 900 μm, from about 400 to about 800 μm, from about 500 to about 700 μm, or about 600 μm.

In some embodiments, the ion exchange resin may comprise porous ion exchange resin beads. In these embodiments, the beads may have any suitable porosity. The porosity of the beads may be precisely engineered by controlling the conditions used in resin synthesis, such as the concentration of the cross-linking agent. The porosity of the beads can affect the surface area:volume ratio of the resin. The ion exchange resin may have any suitable surface area:volume ratio, although in some embodiments it may be beneficial to maximize the surface area:volume ratio in order to maximize the rate of, and capacity for, ion exchange.

In some embodiments, the ion exchange resin may have a BET surface area of about 10-300 $m^2/g$. In some embodiments, the ion exchange resin may have a BET surface area of from about 15 to about 250 $m^2/g$, from about 20 to about 200 $m^2/g$, from about 25 to about 150 $m^2/g$, from about 30 to about 100 $m^2/g$, from about 35 to about 80 $m^2/g$, from about 40 to about 60 $m^2/g$, from about 45 to about 55 $m^2/g$, or about 50 $m^2/g$.

In some embodiments, the ion exchange resin may have a mass density of from about 0.1 to about 1 g/cm. In some embodiments, the ion exchange resin may have a mass density of from about 0.1 to about 0.9 g/cm, from about 0.2 to about 0.8 g/cm, from about 0.3 to about 0.7 g/cm, from about 0.4 to about 0.6 g/cm, or about 0.5 g/cm.

In some embodiments, the ion exchange resin may have a total exchange capacity of from about 0.5 to about 20 $meq/cm^3$. In some embodiments, it may be beneficial to maximize the total exchange capacity to maximize the number of ions that can be adsorbed from vapor. In some embodiments, the resin may have a total exchange capacity of from about 0.1 to about 18 $meq/cm^3$, from about 0.5 to about 15 $meq/cm^3$, or from about 0.7 to about 10 $meq/cm^3$. In some embodiments, the total exchange capacity of the resin is from about 0.5 to about 2 $meq/cm^3$.

The filter may be present in any suitable amount to provide the required extent of filtration. In some embodiments, the filter is present in an amount of from 10 to 100 mg, such as in an amount of from 20 to 80 mg, such as in an amount of from 30 to 70 mg, such as in an amount of from 30 to 50 mg, such as in an amount of from 40 to 70 mg, such as in an amount of from 50 to 70 mg. In some embodiments, the ion exchange resin is present in an amount of from 10 to 100 mg, such as in an amount of from 20 to 80 mg, such as in an amount of from 30 to 70 mg, such as in an amount of from 30 to 50 mg, such as in an amount of from 40 to 70 mg, such as in an amount of from 50 to 70 mg.

In some embodiments, the ion exchange resin may comprise one type of functional group. In other embodiments, it may comprise two or more types of functional group. Having one type of functional group may make the resin more selective in ion exchange, and result in a smaller range of ionic species being adsorbed. Having two or more functional groups may make the resin less selective in ion exchange, and result in a greater range of ionic species being adsorbed.

The functional groups of the resin may be anionic, cationic, and/or neutral. In some embodiments, they may be suitable for removing one or more compounds from vapor. In some embodiments, they may be suitable for removing one or more compounds from vapor which are undesirable for human inhalation. They are of course suitable for removing aldehydes, such as formaldehyde, acrolein and acetaldehyde from vapor.

In some embodiments, the composition of embodiments of the disclosure comprises a Diaion® CR20 ion exchange resin. In some embodiments, the composition of embodiments of the disclosure comprises a XORBEX ion exchange resin. The surface chemistries and porosities of these resins make them highly effective for the selective adsorption of compounds from vapor.

It may be beneficial for the composition of embodiments of the disclosure to comprise a Diaion® CR20 resin. Diaion® CR20 resin is a resin having polyamine groups bonded to a cross-linked polystyrene matrix. Diaion® CR20 resins have previously been used in combustible tobacco products, such as cigarettes, because they can selectively and effectively remove compounds by ion exchange. They have amine functional groups with a high affinity for aldehydes and cyanides. They can thus selectively remove constituents that are undesirable for human inhalation, such as formaldehyde, acrolein and acetaldehyde.

We have found that the use of filter formed from a resin having polyamine groups bonded to a cross-linked polystyrene matrix, such as Diaion® CR20 resin, is particularly advantageous because of the large number of uses over which aldehydes are adsorbed and in particular the large number of uses over which formaldehyde is adsorbed. The longevity of such resins particularly in respect of formaldehyde is extremely useful in the field of e-cigarettes and no suggestion of such advantages can be found in the prior art.

In embodiments wherein the composition of embodiments of the disclosure comprises a Diaion® CR20 resin, the Diaion® CR20 resin may have any suitable properties. In some embodiments, the Diaion® CR20 resin may comprise beads with a mean diameter of from about 500 to about 700 μm, a density of from about 0.4 to about 0.6 g/cm, and a total exchange capacity of from about 0.5 to about 2 meq/cm$^3$. In some embodiments, the Diaion® CR20 resin may comprise beads with a mean diameter of about 600 μm, a density of about 0.5 g/cm, and a total exchange capacity of about 1 meq/cm$^3$.

In some embodiments the filter is or comprises an ion exchange resin has one or more of the following properties: a mean bead diameter of from about 20 to about 1200 μm; a BET surface area of from about 10 to about 300 m$^2$/g; a mass density of from about 0.1 to about 1 g/cm$^3$; and a total exchange capacity of from about 0.5 to about 2 meq/cm$^3$.

Embodiments of the disclosure will now be described with reference to the following non-limiting example.

Example

The aim of the current study was to investigate a filter material that could still exhibit some filtration efficiency when used for multiple inhalations. Synthetic AC beads (Blucher GmbH) which have been found to be an exceptionally efficient filter and CR20 (Mitsubishi Chemical Company) which is selective and highly efficient for aldehydes (and especially formaldehyde), were chosen as the adsorbents of choice [Branton et al., Adsorption Sci. & Technology, 29, 117-138 (2011), Branton et al., Chem. Central. 5:15 (2011)].

Experimental

Activated Carbon was supplied by Blucher GmbH. CR20 was supplied by Mitsubishi Chemical Company. Material characteristics are shown in Table 1.

TABLE 1

Filter Additive Characteristics

| Adsorbent | AC | CR20 |
|---|---|---|
| Particle shape | Spherical | Spherical |
| Mean Particle size (mm) | 0.40 | 0.60 |
| Apparent density (g/cm$^3$) | 0.37 | 0.64 |
| *Surface area (m$^2$/g) | 1660 (micro/meso/macroporous) | 44 (macroporous) |
| *Total pore volume (cm$^3$g$^{-1}$) | 0.94 | 0.08 |
| Surface chemistry | — | Amine functionality |

*From nitrogen adsorption at 77 K

A predetermined weight of additive (60-150 mg) was weighed into a filter. Each use was six puffs, equivalent to smoking one tobacco cigarette.

Selected aldehydes were measured using real time Time of Flight Mass Spectrometry (TOF-MS) (acetaldehyde, 1,3-butadiene, acetone, isoprene, MEK, benzene, toluene) and HPLC (acetaldehyde, acetone, acrolein, butyraldehyde, crotonaldehyde, formaldehyde, MEK, propionaldehyde). Aldehyde yields were measured from the whole aerosol (vapor+particulate phases). It is known that 70% of formaldehyde is present in the vapor phase, selective filtration of formaldehyde (or any compound) in the particulate phase is extremely unlikely and thus a selective reduction of 70% is the maximum likely. By contrast, other aldehydes such as acetaldehyde are essentially exclusively in the vapor phase and thus a 100% selective removal is theoretically possible.

AC samples were also evaluated using a Rubotherm InfraSorp (Fraunhoffer Institute, Dresden, Germany) which enables material (both fresh and previously contacted with aldehydes) to be screened for their adsorption characteristics.

n-Butane was used as the test adsorbate gas. The sample size required was only 200 mg and 20 samples could be screened in 2 hours.

Results and Discussion

FIGS. 1(*i*) to (*v*) show the effect on filtration efficiency as a function of usage using 60 mg and 150 mg of Activated Carbon beads in the filter by TOF-MS and HPLC analytical procedures and 60 mg CR20 by HPLC.

Despite the different analytical methods used for the measurement of aldehydes, it is clear from the figures that there was good agreement between the two techniques. Filtration efficiencies differ for different aldehydes, i.e. each aldehydes has a different breakthrough profile. For example, re-using AC 8 times results in the filtration efficiency falling:

80→20% for acetone & 90→40% for crotonaldehyde using 60 mg of AC and

90→60% for acetone & 90→70% for crotonaldehyde using 150 mg of AC.

CR20 is an excellent filter for formaldehyde. Even using only 60 mg in the filter, the filtration efficiency does not significantly fall over 5 uses (30 puffs).

By measuring the heat of adsorption (using n-butane) it was found that there was a trend with the filtration performance of a filter material.

FIG. 2 shows the thermal response of AC that was used 5 times (using 150 mg in the filter) and 'fresh' AC upon exposure to n-butane gas.

The greater the peak area above the y-axis, the stronger the adsorption (greater heat loss). This implies a greater available surface area and thus greater filtration efficiency. The greater the peak area below the y-axis, the stronger the desorption (greater heat rise) and thus the pores are partially filled suggesting a lower available surface area and lower filtration efficiency (and also higher odor from desorption of volatile species).

The peak areas (weight normalized) for adsorption and desorption and the ratio of desorption to adsorption are shown in Table 2 for AC.

TABLE 2

Adsorption-Desorption Peak Areas for AC

| | AC | | |
|---|---|---|---|
| | Adsorption peak area (arb units) | Desorption peak area (arb units) | Desorption:Adsorption ratio |
| Fresh | 13.6 | 0 | 0 |
| Used once | 6.4 | −1.2 | −0.2 |
| Used twice | 3.8 | −2.4 | −0.6 |
| Used 3 times | 2.3 | −5.6 | −2.4 |
| Used 5 times | 1.5 | −9.4 | −6.5 |

As can be seen from Table 2, the adsorption peak area falls with increasing number of uses, whilst the desorption peak increases.

Purging with dry air at room temperature was investigated to see if the AC surface area could be regenerated.

There is a significant loss in the AC adsorption capacity (for butane) of ca 90% after 5 reuses.

The percentage of adsorption sites for butane on AC before and after purging are summarized below.

| Fresh | used once | used 2 times | used 3 times | used 5 times |
|---|---|---|---|---|
| 100% | 46→83% | 27→55% | 16→48% | 11→35% |

The above shows that after one use, the number of available adsorption sites fell to 46%. By purging with dry air at room temperature, the number of available adsorption sites could be increased to 83% (it is extremely difficult to desorp the volatile species from the smallest of pores without using heat and a vacuum and so a 100% regeneration in practice would be unlikely).

After two uses, the number of available adsorption sites fell to 27%. By purging with dry air at room temperature, the number of available adsorption sites could be increased to 55% and so on.

CONCLUSIONS

Activated Carbon (60-150 mg) can be reused at least 5 times whilst maintaining some enhanced filtration.

CR20 (60 mg) can be reused at least 5 times without a significant drop in formaldehyde filtration efficiency.

The AC activity can be (partially) regenerated via purging with dry air.

Various modifications and variations of the present invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in chemistry or related fields are intended to be within the scope of the following claims.

The invention claimed is:

1. An electronic vapor provision system comprising:
- a vaporizer for vaporizing liquid for inhalation by a user of the electronic vapor provision system;
- a power supply comprising a cell or battery for supplying power to the vaporizer; and
- a filter for filtering vaporized liquid prior to inhalation by the user of the electronic vapor provision system,
- wherein the filter can partially or completely remove from the vapor one or more aldehydes present in the vapor, wherein the filter has an amine functional group which reacts with aldehydes.

2. An electronic vapor provision system according to claim 1 wherein the filter is an ion exchange resin.

3. An electronic vapor provision system according to claim 1 wherein the filter can partially or completely remove from the vapor each aldehyde present in the vapor.

4. An electronic vapor provision system according to claim 1 wherein the filter can partially or completely remove from the vapor one or more aldehydes selected from acetaldehyde, acrolein, butyraldehyde, crotonaldehyde, formaldehyde and propionaldehyde.

5. An electronic vapor provision system according to claim 1 wherein the filter can partially or completely remove from the vapor at least formaldehyde.

6. An electronic vapor provision system according to claim 1 wherein the filter can partially or completely remove from the vapor each of acetaldehyde, acrolein, butyraldehyde, crotonaldehyde, formaldehyde and propionaldehyde.

7. An electronic vapor provision system according to claim 1 wherein at least 30% of the one or more aldehydes present in the vapor are removed from the vapor by the filter.

8. An electronic vapor provision system according to claim 1 wherein at least 50% of the one or more aldehydes present in the vapor are removed from the vapor by the filter.

9. An electronic vapor provision system according to claim 1 wherein after 30 inhalations of vapor have passed through the filter at least 40% of the one or more aldehydes present in the vapor are removed from the vapor by the filter.

10. An electronic vapor provision system according to claim 1 wherein after 30 inhalations of vapor have passed through the filter at least 40% of formaldehyde present in the vapor is removed from the vapor by the filter.

11. An electronic vapor provision system according to claim 1 wherein after 100 inhalations of vapor have passed through the filter at least 40% of formaldehyde present in the vapor is removed from the vapor by the filter.

12. An electronic vapor provision system according to claim 1 wherein after 250 inhalations of vapor have passed through the filter at least 40% of formaldehyde present in the vapor is removed from the vapor by the filter.

13. An electronic vapor provision system according to claim 1 wherein the filter is a resin having polyamine groups bonded to a cross-linked polystyrene matrix.

14. An electronic vapor provision system according to claim 13 wherein the filter is DIAION® CR20.

* * * * *